United States Patent [19]

Nishimoto

[11] Patent Number: 4,791,847

[45] Date of Patent: Dec. 20, 1988

[54] PARAMETER SETTING SYSTEM FOR ELECTRONIC MUSICAL INSTRUMENT

[75] Inventor: Tetsuo Nishimoto, Hamamatsu, Japan

[73] Assignee: Nippon Gakki Seizo Kabushiki Kaisha, Hamamatsu, Japan

[21] Appl. No.: 27,222

[22] Filed: Mar. 17, 1987

[30] Foreign Application Priority Data

Mar. 18, 1986 [JP] Japan ..... 61-61095

[51] Int. Cl.[4] ..... G10H 1/02

[52] U.S. Cl. ..... 84/1.21; 84/1.24; 84/1.28

[58] Field of Search ..... 84/1.19–1.28

[56] References Cited

U.S. PATENT DOCUMENTS 4,432,265 2/1984 Oya et al. ..... 84/1.19
4,483,231 11/1984 Hirano ..... 84/1.19
4,512,230 4/1985 Ezawa et al. ..... 84/1.24

FOREIGN PATENT DOCUMENTS 0192984 1/1986 Fed. Rep. of Germany .
60-149089 8/1985 Japan .

*Primary Examiner*—Patrick R. Salce

*Assistant Examiner*—J. Sterrett

*Attorney, Agent, or Firm*—Spensley Horn Jubas & Lubitz

[57] ABSTRACT

A parameter setting system for an electronic musical instrument has a predetermined number of panel switches to which desired parameters can be selectively assigned by the player. The system comprises a RAM having a parameter area in which a group of parameters determining characteristics of a tone are stored, the number of parameters being greater than the number of the panel switches. The RAM also has an identification-number area for storing identification numbers of those parameters which are assigned respectively to the panel switches. When a reassignment switch is depressed with an entry switch, the system is brought into a reassignment mode. In this condition, the player selects a desired one of the parameters using up and down switches for changing the identification number and a display unit for displaying the identification number. The player then depresses one of the panel switches to which the selected parameter is to be assigned, whereupon the displayed identification number is stored into the identification-number area of the RAM at a position corresponding to the depressed panel switch.

14 Claims, 8 Drawing Sheets

TB 1

| | |
|---|---|
| 1 | MASTER TUNING |
| 2 | PITCH BEND RANGE |
| 3 | PITCH BEND STEP |
| 4 | PORTAMENTO ON/OFF |
| | ⋮ |
| 9 | SUSTAIN ON/OFF |
| 10 | SUSTAIN TIME |

FIG.2

17

| | |
|---|---|
| TON FLG | MA 1 |
| FUN FLG | MA 2 |
| REA FLG | MA 3 |
| REF FLG | MA 4 |
| SWN O | MA 5 |
| FUN REG | MA 6 |
| FUN NO | MA 7 |
| IDENTIFICATION NUMBER OF FUNCTION ASSIGNED TO PANEL SW PSWi | REFMEM |
| TONE PARAMETERS FOR CURRENTLY GENERATED MUSICAL TONE | TPMEM |
| DATA FOR OTHER CONTROL ELEMENTS | MA 8 |

FIG.4

TB 2

| | | | | | |
|---|---|---|---|---|---|
| 1 | MASTER TUNING | 11 | ATTACK RATE | 21 | KEY TRANSPOSE |
| 2 | PITCH BEND RANGE | 12 | ATTACK LEVEL | 22 | LFO SPEED |
| 3 | PITCH BEND STEP | 13 | FIRST DECAY RATE | | ⋮ |
| 4 | PORTAMENTO ON/OFF | 14 | SUSTAIN LEVEL | | |
| | ⋮ | | ⋮ | | |
| 9 | SUSTAIN ON/OFF | | | 29 | KEYBOARD LEVEL SCALING |
| 10 | SUSTAIN TIME | 20 | RELEASE RATE | 30 | KEYBOARD RATE SCALING |

FIG.3

PARAMETER SETTING SYSTEM FOR ELECTRONIC MUSICAL INSTRUMENT

BACKGROUND OF THE INVENTION

1. Field of the Invention

This invention relates generally to an electronic musical instrument and more particularly to a parameter setting system for setting parameters used in such an electronic musical instrument which system is easy to operate, the parameters including those determining characteristics of a tone, those selecting and controlling musical effects and those controlling other musical functions.

2. Prior Art

In general, an electronic musical instrument is provided with a variety of operable members such as switches, knobs and the like for setting parameters to the electronic musical instrument prior to and during performing a music. The player of the electronic musical instrument can set, by manipulating the operable members, such parameters to desired values or states thereby to determine characteristics of tone such as a tone pitch, a tone color and a tone volume, to select and control musical effects such as a vibrato and a portamento, and to select and control other musical functions such as an automatic accompaniment playing function and an automatic music playing function.

The conventional electronic musical instrument has such a construction that each of the operable members is assigned only a specific one of the plurality of parameters. As a result, when the number of parameters is increased, the number of operable members is also increased. Thus, the conventional electronic musical instrument has needed a control panel of a relatively large size to mount the large number of operable members, which has resulted in an increase of the size of the electronic musical instrument per se. Moreover, since the number of operable members has thus been large, it has been difficult for the player to locate tee operable member which he wishes to operate. These problems have been serious particularly when the electronic musical instrument is of such a kind that many parameters need be set, that is to say, when the electronic musical instrument is of a high grade.

To solve the above problems, there has been proposed another parameter setting system such as that disclosed in Japanese Patent Application Laid-Open No. 60-149089. In this improved conventional system, the parameters to be set to the instrument are divided into plural groups in accordance with their kinds, such as tone colors and musical effects, so that each of the parameters in one group and the corresponding parameters in the other groups are commonly assigned to a respective one of the operable members. When one of the plural parameters must be set to a desired value, that group including the parameter to be set is first selected, and then the operable member corresponding to this parameter is operated. With this arrangement, the number of operable members and hence the size of the control panel can be remarkably reduced.

With this improved conventional system, however, the parameters selectable by each operable member are determined by the manufacturer and can not be changed by the player. Thus, this conventional system has not yet been satisfactory for the player from the viewpoint of operability.

In general, every player wants to perform a music in his own manner. Therefore, the musical effects, tone colors and the like selected in accordance with the parameters are different from player to player. The kinds of those parameters which are changed frequently are also different depending on the player. From the viewpoint of operability, those parameters which need be frequently changed should be assigned to those operable members which are disposed at such a position on the panel that the player can easily access, or can manipulate the operable members with less possibility of mistake.

SUMMARY OF THE INVENTION

It is therefore an object of the present invention to provide a parameter setting system for an electronic musical instrument in which the player can selectively assign any desired one of the parameters to each operable member to thereby improve the operability of the electronic musical instrument.

According to a first aspect of the invention, there is provided a parameter setting system for an electronic musical instrument for setting one or more of plural parameters each for determining a characteristic of a tone which is generated by a tone generating means incorporated in the electronic musical instrument, the parameter setting system comprising one or more manually operable members; first memory means for storing the plural parameters in such an arrangement that each of the stored parameters can be designated by identification data; data generating means having first manual control means for generating data whose value is determined by a manual operation of the first manual control means; second memory means having one or more addresses corresponding respectively to the one or more operable members; writing means responsive to a manual operation of each of the operable members for writing the data generated by the data generating means into a respective one of the addresses of the second memory means, as the identification data; parameter setting means for bringing each of those of the plural parameters in the first memory means designated by the identification data contained in a corresponding one of the addresses of the second memory means into a desired condition; and feeding means for feeding the parameters contained in the first memory means to the tone generating means so that the tone generated by the tone generating means has the characteristics determined by the fed parameters.

According to a second aspect of the invention, there is provided a parameter setting system for an electronic musical instrument comprising plural operating members each being manually operable; assignment manner designating means for designating an assignment manner; assigning means connected to the assignment manner designating means for assigning a certain value of a parameter from among plural parameters, each of which determines a characteristic of a tone to be generated, to one of the plural operating members in accordance with the assignment manner, the parameter being able to take at least three values and the certain value being one of the at least three values; and tone generating means for generating a tone signal representing the tone to be generated, whose characteristic is determined by the certain value, when the operating member to which the certain value is assigned is operated.

According to a third aspect of the invention, there is provided a parameter setting system for an electronic musical instrument comprising plural operating members each being manually operable; assignment manner designating means for designating an assignment manner; assigning means connected to the assignment manner designating means for assigning an effect from among plural effects to one of the plural operating members in accordance with the assignment manner; and tone generating means for generating a tone signal representing a tone to be generated, the effect being imparted to the tone when the operating member to which the effect is assigned is operated.

BRIEF DESCRIPTION OF THE DRAWINGS

FIG. 2 is an illustration showing factory-set functions to be assigned respectively to the panel switches $PSW_1$ to $PSW_{10}$ of the instrument 10 of FIG. 1;

FIG. 3 is an illustration showing user-set functions to be selectively assigned to the panel switches $PSW_1$ to $PSW_{10}$ by the player;

FIG. 4 is an illustration showing the contents of the data/working-area RAM 17 of the instrument 10 of FIG. 1;

FIG. 6 is a flow chart of a subroutine executed by the CPU 11 when the tone switch 30 is turned on;

FIG. 7 is a flow chart of a subroutine executed by the CPU 11 when any one of the panel switches $PSW_1$ to $PSW_{10}$ is turned on;

FIG. 8 is a flow chart of a subroutine executed by the CPU 11 when the function switch 31 is turned on;

FIG. 9 is a flow chart of a subroutine executed by the CPU 11 when the up switch 38 is turned on;

FIG. 10 is a flow chart of a subroutine executed by the CPU 11 when the down switch 39 is turned on;

FIG. 11 is a flow chart of a subroutine executed by the CPU 11 when the reassignment switch 32 is turned on;

DESCRIPTION OF THE PREFERRED EMBODIMENTS OF THE INVENTION

An embodiment of the present invention will now be described with reference to the accompanying drawings.

Figure 1:
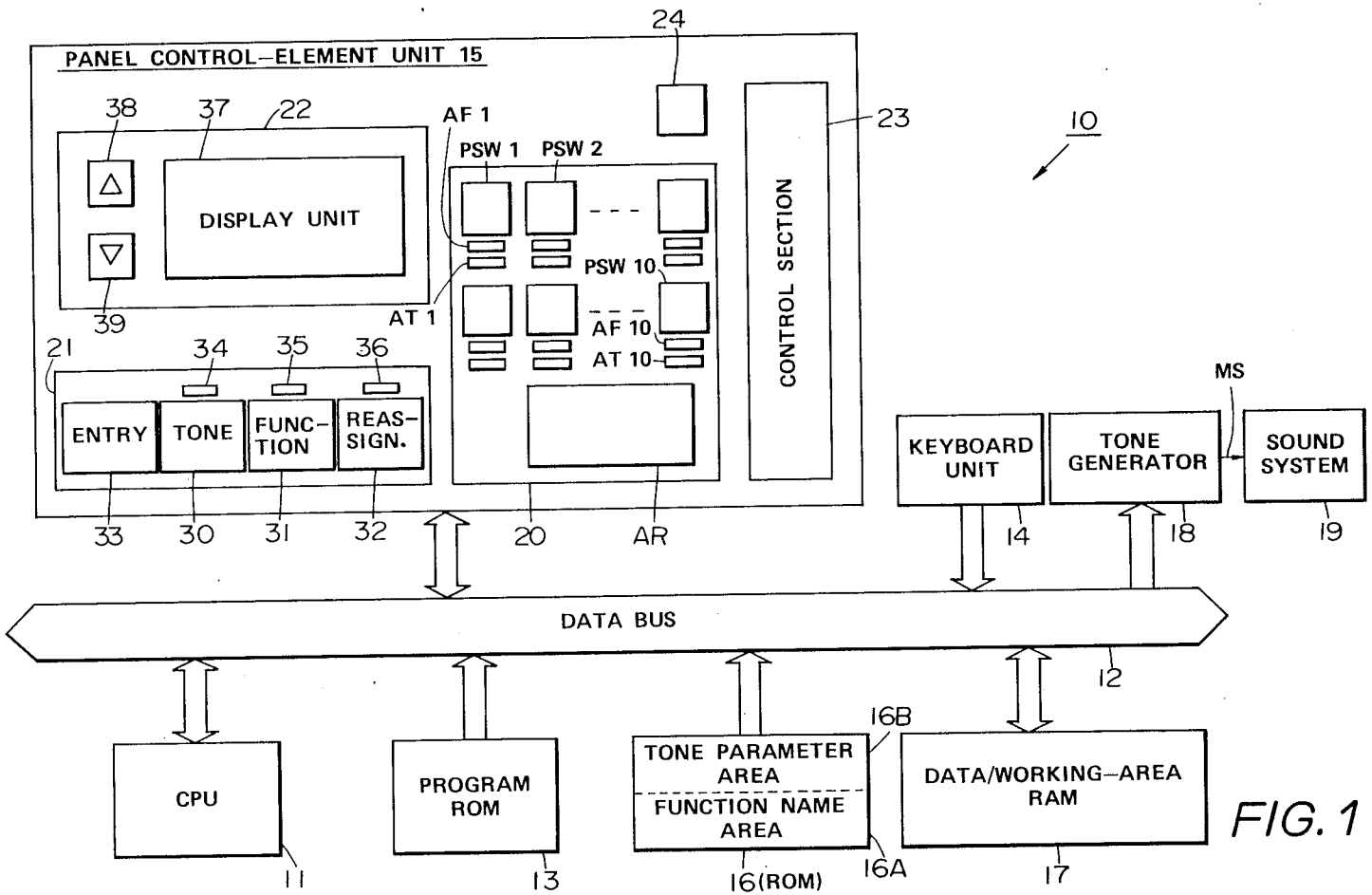
FIG. 1 is a block diagram of an electronic musical instrument 10 incorporating a parameter setting system provided in accordance with the present invention.

FIG. 1 shows an electronic musical instrument 10 incorporating a parameter setting system provided in accordance with an embodiment of the present invention. This instrument 10 has a central processing unit (CPU) 11 which reads, via a data bus 12 and in accordance with control programs stored in a program ROM 13, key information inputted through a keyboard unit 14 and panel information inputted through a panel control-element unit 15.

The CPU 11 processes the above input information and information stored in a ROM 16, using a data/-working-area RAM 17 which is connected thereto through the data bus 12. The CPU 11 obtains key data and parameter data as a result of the above processing, and supplies these data to a tone generator 18. The tone generator 18 forms a musical tone signal MS from the key data and the parameter data, and supplies the signal MS to a sound system 19, whereby a musical tone is outputted from the sound system 19.

The panel control-element unit 15 will now be more fully described. The panel control-element unit 15 comprises a panel switch section 20, a mode selection section 21, a parameter setting section (or a multi-menu section) 22, a control section 23 for other control elements, and a power switch 24.

The panel switch section 20 is provided for designation of a parameter or a function to be set or changed, and comprises ten panel switches $PSW_1$ to $PSW_{10}$ each, for example, of a momentary push-button type. Each of the panel switches $PSW_1$ to $PSW_{10}$ designates one of those parameters included in a parameter group selected in accordance with a depressed one of switches 30 to 33, which are provided in the mode selection section 21. More specifically, when the tone-color designation mode switch (hereinafter referred to simply as "tone switch") 30 is depressed (or turned on), the panel switches $PSW_1$ to $PSW_{10}$ serve as switches for designating tone colors. When the factory-set-function modification mode switch (hereinafter referred to simply as "function switch") 31 is turned on, the panel switches $PSW_1$ to $PSW_{10}$ serve to designate factory-set parameters or function other than the above-described tone-color designating parameters. When the user-set-function mode switch (hereinafter referred to simply as "reassignment switch") 32 is turned on together with the entry switch 33, each of the panel switches $PSW_1$ to $PSW_{10}$ serves as a switch for assigning the parameter or function selected by the player to itself. When the reassignment switch 32 is turned on alone, each of the panel switches $PSW_1$ to $PSW_{10}$ serves to select the parameter or function assigned thereto by the player.

The tone switch 30, the function switch 31 and the reassignment switch 32 are provided respectively with indicators 34, 35 and 36 each composed, for example, of a LED. When one of the switches 30 to 32 is depressed, a corresponding one of the LED indicators 34 to 36 comes on and the remaining indicators go out, so that the player can determine in which mode the instrument 10 is operating.

In this embodiment, ten kinds of parameters and functions, such as a master tuning, a pitch bend range, a pitch bend step, a portamento ON/OFF, . . . , a sustain ON/OFF and a sustain time, which are considered to be most frequently changed by the player, are selected by the manufacturer as the factory-set functions, as shown in Table TB1 of FIG. 2. The portamento ON/OFF parameter determines whether the portamento is enabled or disabled, and this is true of the sustain ON/-OFF parameter. These factory-set functions, that is, the master tuning, the pitch bend range, the pitch bend step, the portamento ON/OFF,. the sustain ON/OFF and the sustain time, are fixedly assigned to the panel switches $PSW_1$ to $PSW_{10}$, respectively. A name of each of these factory-set functions is printed on a panel surface of the panel control-element unit 15 at a position $AF_i$ (i is one of "1" to "10") adjacent to a respective one of the switches $PSW_1$ to $PSW_{10}$. Identification numbers of the factory-set functions shown in FIG. 2 are so determined as to coincide with the numbers of the switches $PSW_1$ to $PSW_{10}$ so that data relating to the parameters can be easily processed in this system.

As shown in Table TB2 of FIG. 3, there are provided thirty kinds of user-set functions (parameters and functions) which can be selectively assigned to the panel switches $PSW_1$ to $PSW_{10}$. These parameters and functions are given identification numbers "1" to "30", respectively, so that the player can designate one of the parameters and functions to be assigned to the switch $PSW_i$ ("i" is one of "1" to "10") by selecting its identification number at the multi-menu section 22. The user-set functions may include a vibrato ON/OFF, a tremolo ON/OFF, a chorus ON/OFF, an ensemble ON/OFF and a reverb. ON/OFF. In this embodiment, the list of the parameters and functions shown in FIG. 3 is printed on the panel surface of the panel control-element unit 15 at a portion AR thereof. Therefore, the player can perform an assignment of the parameters and functions to the switches $PSW_1$ to $PSW_{10}$ without remembering the identification numbers thereof.

Those of the user-set functions, which are given the identification numbers of "1" to "10", are the same as the factory-set functions, so that the player can assign these principal parameters and functions in a simple manner.

The contents of Tables TB1 and TB2 shown in FIGS. 2 and 3 are stored in a function name area 16A of the ROM 16, and are read therefrom by the CPU 11 in accordance with the turning-on operation of the switches 31 to 33 and the switches $PSW_1$ to $PSW_{10}$.

This embodiment provides ten selectable tone colors, which include a flute tone, a piano tone and a violin tone, and are fixedly assigned respectively to the panel switches $PSW_1$ to $PSW_{10}$. A name of each of the selectable tone colors are printed on the panel surface at a position $AT_i$ adjacent to a respective one of the switches $PSW_1$ to $PSW_{10}$. The player can therefore confirm the desired tone color when he selects it by turning on a corresponding one of the switches $PSW_1$ to $PSW_{10}$. Tone parameters for each tone color, which include data representative of the tone color and thirty kinds of parameters corresponding to those shown in FIG. 3, are stored in a tone parameter area 16B of the ROM 16. These tone parameters are read from the area 16B by the CPU 11 in accordance with the operation of the tone switch 10 and the switches $PSW_1$ to $PSW_{10}$.

The multi-menu section 22 comprises a display unit 37 of the liquid crystal type, an up switch 38 for increasing the value of the parameter to be set by a predetermined amount, and a down switch 39 for decreasing the value of the parameter to be set by the predetermined amount. In the case of a function, the up switch 38 serves as a switch for bringing the function into an ON state. Similarly, the down switch 39 serves as a switch for bring the function into an OFF state. The display unit 37 displays, in accordance with the turning-on operation of the switches 30 to 33 of the mode selection section 21 and the panel switches $PSW_1$ to $PSW_{10}$, the tone color, the name and value of the parameter, the name and ON/OFF state of the function, the identification number of the parameter or function The player can change the value of the displayed parameter and the state of the displayed function, by operating the up and down switches 38 and 39.

As shown in FIG. 4, the data/working-area RAM 17 has a plurality of register sections MA1 to MA8, REFMEM and TPMEM each for storing data determined by the operation of the various switches provided on the panel of the panel control-element unit 15. The register section MA1 stores a tone flag TONFLG, which is rendered "1" when the tone switch 30 is turned on. The register section MA2 stores a function flag FUNFLG, which is rendered "1" when the function switch 31 is turned on. The register section MA3 stores a reassignment flag REAFLG, which is rendered "1" when the reassignment switch 32 and tee entry switch 33 are turned on substantially simultaneously. The register section MA4 stores a reassignment function flag REFFLG, which is rendered "1" when the reassignment switch 32 is turned on alone. In this embodiment, only one of the four flags TONFLG, FUNFLG, REAFLG and REFFLG in the register sections MA1 to MA4 is rendered "1" at a time so that the current mode, selected in the panel control-element unit 15 particularly for the panel switches $PSW_1$ to $PSW_{10}$, can be determined in accordance with the states of these flags.

The register section MA5 stores the switch number SWNO of that panel switch PSW which was turned on last. The register section MA6 stores the identification number FUNNO of that parameter or function which is selected as a parameter or a function whose value or state is to be set or changed. The register section MA7 stores the identification number of that parameter or function which is selected as a parameter (function) which should be assigned to one of the panel switches $PSW_1$ to $PSW_{10}$.

The register section REFMEM serves as a reassignment function memory which stores identification numbers of those parameters and functions which are assigned by the player respectively to the panel switches $PSW_1$ to $PSW_{10}$. The register section REFMEM therefore has ten storage areas corresponding respectively to the panel switches $PSW_1$ to $PSW_{10}$. The register section TPMEM serves as a tone parameter memory for storing a set of tone parameters which correspond to the currently selected tone color. More specifically, the register section TPMEM stores the tone parameters, which the CPU 11 feeds from the tone parameter area 16B of the ROM 16, and outputs to the tone generator 18.

The register section MA8 stores data fed from the control section 23 as well as data fed from the keyboard unit 14.

The operation of this electronic musical instrument 10 will now be described with reference to flow charts shown in FIGS. 5 to 15.

Figure 5:
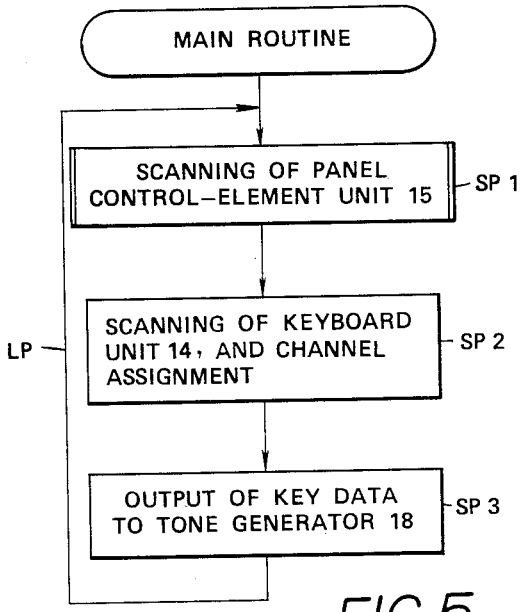
FIG. 5 is a flow chart of a main routine executed by the CPU 11 of the instrument 10 of FIG. 1.

When the power switch 24 of the panel control-element unit 15 is turned on, the CPU 11 starts to execute a main routine of FIG. 5 which is stored in the program RAM 13. At the first step SP1 of this main routine, the CPU 11 scans the switches provided on the panel control-element unit 15 to detect any depression of switch (or any ON-event). The CPU 11 then executes one of routines shown in FIGS. 6 to 11 which corresponds to the switch just depressed. At the next step SP2, the CPU 11 scans the keys of the keyboard unit 14 to detect any depression and release of key (or any key-on and key-off event), and carries out a processing for assigning the key, of which key-on or key-off event has just been detected, to one of tone generating channels of the tone generator 18. At the next step SP3, the CPU 11 outputs the key data relating to the key thus assigned to the tone generating channel to the tone generator 18. The processing then returns to the step SP1 so that steps SP1 to SP3 are repeatedly executed along a loop LP, whereby the desired tone is outputted from the sound system 19.

In this condition, the player operates the control elements of the panel control-element unit 15 for the purpose, for example, of selecting a tone color, setting or changing the values or states of the factory-set functions, reassigning desired ones of the parameters and functions to the panel switches PSW, or setting or changing the values or states of the parameters and functions thus reassigned by the player to the panel switches PSW.

In this embodiment, each of the above purposes can be attained by one of predetermined operating procedures shown in FIGS. 12 to 15.

Each of the operating procedures and the operation of the instrument 10 performed in accordance with the selected procedure will now be described.

I Selection of tone color

I-1 Operating procedure

Figure 12:
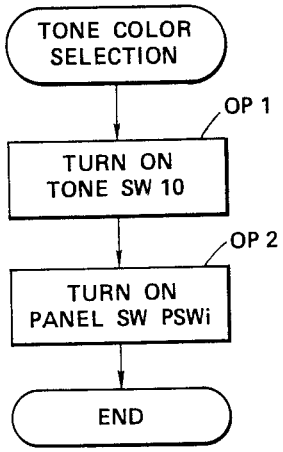
FIG. 12 is a flow chart of an operating procedure for selecting a tone color.

When it is desired that the musical tone be generated with a new tone color, the player first turns on the tone switch 30 at step OP1 of FIG. 12, and confirms that the LED indicator 34 comes on. The player then finds the name of the tone color, which he wishes to select, from among the names printed on the panel at AT1 to AT10, and turns on the corresponding panel switch $PSW_i$ (step OP2). Shown in FIG. 12 is the basic operating procedure for the selection of tone color. Therefore, once the operation of the step OP1 has been performed, another tone color can be selected only by performing the operation of the step OP2 again.

I-2 Operation of the instrument 10

Figure 6:
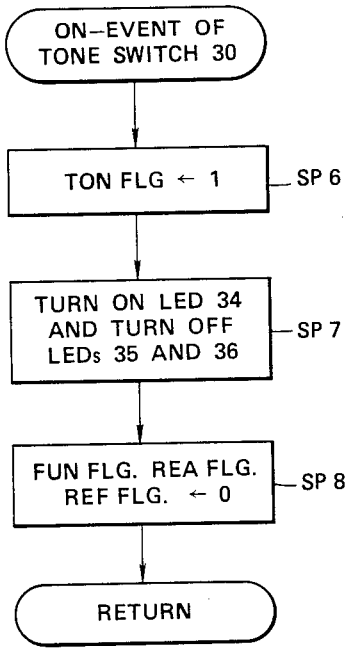

When the turning-on operation of the tone switch 30 performed at the step OP1 of FIG. 12 is detected, the CPU 11 begins to execute a subroutine shown in FIG. 6. At the first step SP6 of this subroutine, the CPU 11 renders the tone flag TONFLG "1". Then, the CPU 11 turns on the LED indicator 34 corresponding to the tone switch 30, and turns off the other LED indicators 35 and 36, at the next step SP7. Thus, the player can confirm that the instrument 10 is now in the mode for selecting a tone color. At the next step SP8, the CPU 11 clears the flags FUNFLG, REAFLG and REFFLG to cancel the precedingly selected mode. Then, the processing returns to the main routine.

Figure 7:
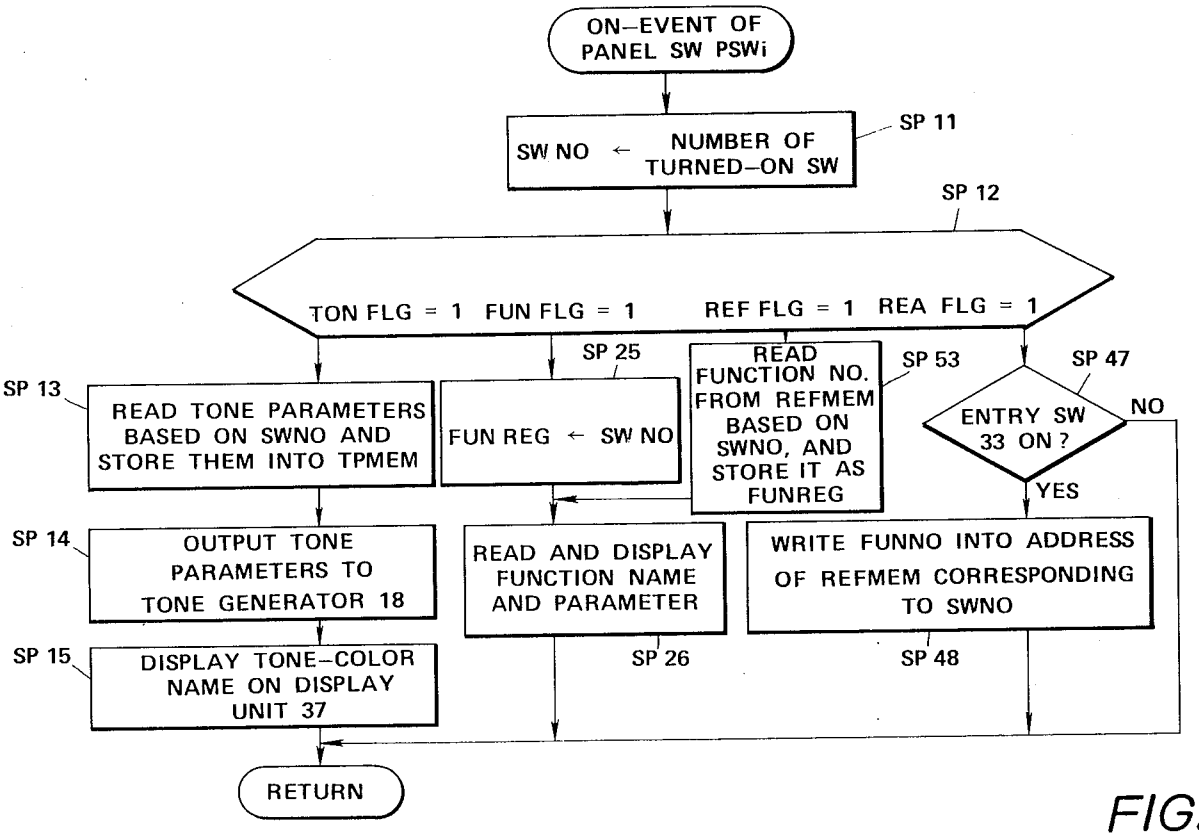

When the turning-on operation of the panel switch $PSW_i$ ("i" is any one of "1" to "10") performed at the step OP2 of FIG. 12 is detected during the time when the CPU 11 is carrying out the processing in the loop LP, a subroutine shown in FIG. 7 begins to be executed. At the first step SP11 of this subroutine, the CPU 11 stores the number SWNO of the panel switch $PSW_j$ just turned on into the register section MA5. For example, where the panel switch $PSW_3$ is turned on, data representative of "3" is stored into the register section MA5.

Then, the CPU 11 determines the currently selected mode based on the contents of the flags TONFLG, FUNFLG, REAFLG and REFFLG at step SP12. In the present case, the tone flag TONFLG is in the state of "1" (refer to the steps SP6 and SP8), so that the processing proceeds to step SP13. At this step SP13, the CPU 11 determines the depressed panel switch $PSW_i$ based on the switch number SWNO stored in the register section MA5, and transfers the tone parameters corresponding to the depressed panel switch $PSW_i$ from the tone parameter area 16B to the register section TPMEM. Teen, the CPU 11 outputs the tone parameters, thus stored in the register section TPMEM, through the data bus 12 to the tone generator 18 at step SP14. At the next step SP15, the CPU 11 displays the name of the selected tone color based on the switch number SWNO in the register area MA5 so that the player can confirm the selected tone color. The CPU 11 then returns its control to the main routine to terminate this tone-color selecting processing. As a result, the tone generator 18 begins to generate a musical tone with the newly selected tone color.

II Change of contents of factory-set parameter

II-1 Operating procedure

Figure 13:
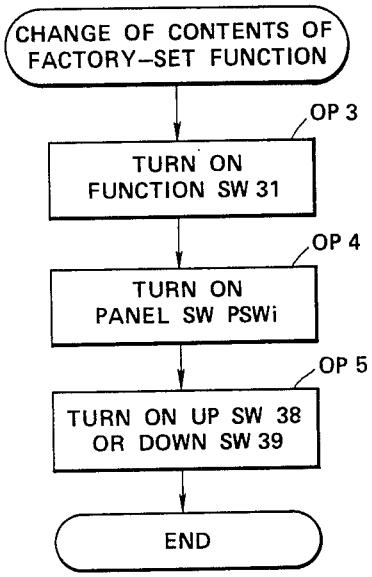
FIG. 13 is a flow chart of an operating procedure for changing the contents of a selected factory-set function.

When it is desired that the contents of the parameter or function of the factory-set functions be changed, the player operates the control elements in accordance with the operating procedure shown in FIG. 13. More specifically, the player first turns on the function switch 31 at step OP3, and confirms that the LED indicator 35 corresponding to the function switch 31 comes on. The player then finds the name of that factory-set function, which he wishes to select, from among the names printed on the panel at AF1 to AF10, and turns on the corresponding panel switch $PSW_i$ (step OP4). At the next step OP5, the player turns on the up switch 38 or the down switch 39 until the contents of the parameter or function displayed on the display unit 37 become equal to the desired value or state.

Shown in FIG. 13 is the basic operating procedure for the change of contents of the factory-set function. Therefore, once the operation of the step OP3 has been performed, the contents of other factory-set functions can be changed by repeatedly performing the operation of the steps OP4 and OP5.

II-2 Operation of the instrument 10

Figure 8:
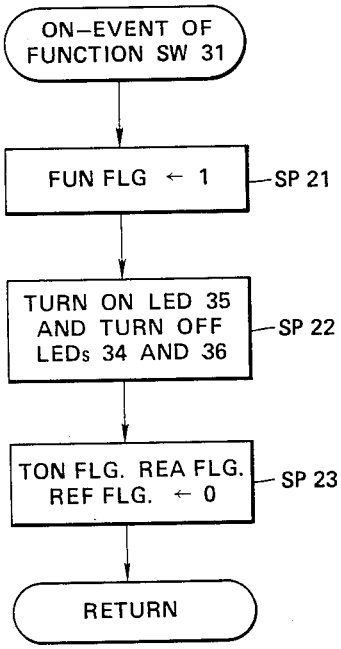

When the turning-on operation of the function switch 31, performed at the step OP3 of FIG. 13, is detected, the CPU 11 begins to execute a subroutine shown in FIG. 8. At the first step SP21 of this subroutine, the CPU 11 renders the function flag FUNFLG "1". Then, the CPU 11 turns on tee LED indicator 35 corresponding to the function switch 31, and turns off the other LED indicators 34 and 36, at the next step SP22. Thus, the player can confirm that the instrument 10 is now in the mode for changing the contents of the factory-set function. At the next step SP23, the CPU 11 clears the flags TONFLG, REAFLG and REFFLG to cancel the precedingly selected mode. Then, the processing returns to the main routine.

When the turning-on operation of the panel switch $PSW_i$, performed at the step OP4 of FIG. 13, is detected during the time when the CPU 11 is carrying out the processing in the loop LP, the subroutine shown in FIG. 7 begins to be executed. At the first step SP11 of this subroutine, the CPU 11 stores the number of the panel switch $PSW_i$ just turned on into the register section MA5.

In the present case, only the function flag FUNFLG is in the state of "1" (refer to the steps SP21 and SP23), so that the processing proceeds from the step SP12 to step SP25. At this step SP25, the CPU 11 reads the switch number SWNO from the register section MA5, and stores it into the register section MA6 as the identification number FUNREG of the factory-set function whose contents are to be changed. At the next step SP26, the CPU 11 reads, from the function name area 16A of the ROM 16, data representative of the name of this function based on the identification number FUNREG. The CPU 11 then reads the tone parameter corresponding to the selected function from the register area TPMEM, and causes the display unit 37 to display the read parameter together with the function name. Then, The CPU 11 returns its control to the main routine to terminate this processing.

Thus, the player can confirm that the the panel switch $PSW_i$ corresponding to the selected function has been operated, and can also confirm the current value or state of the factory-set function.

Figure 9:
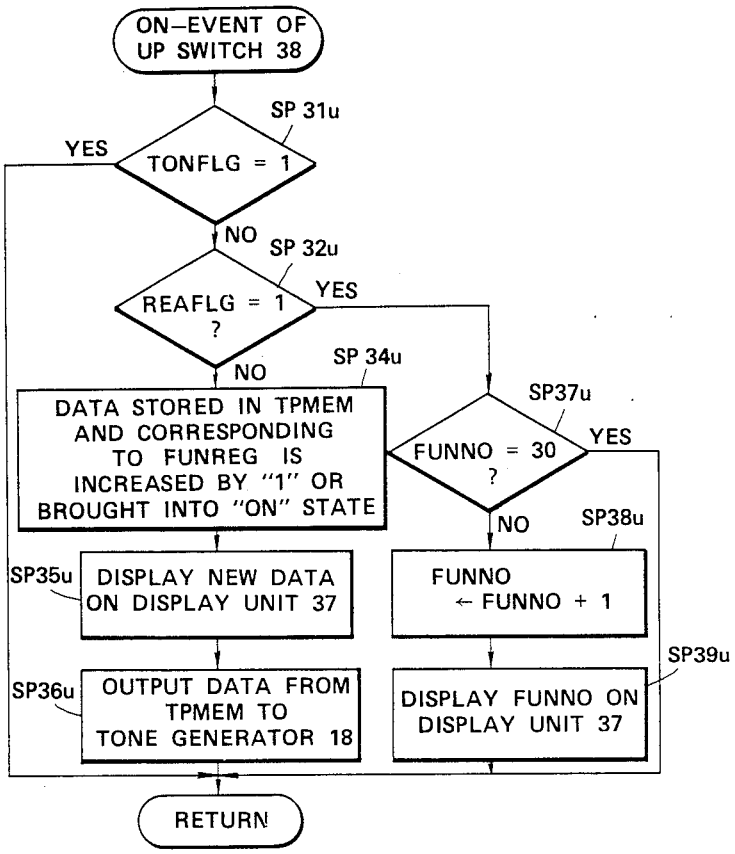
Figure 10:
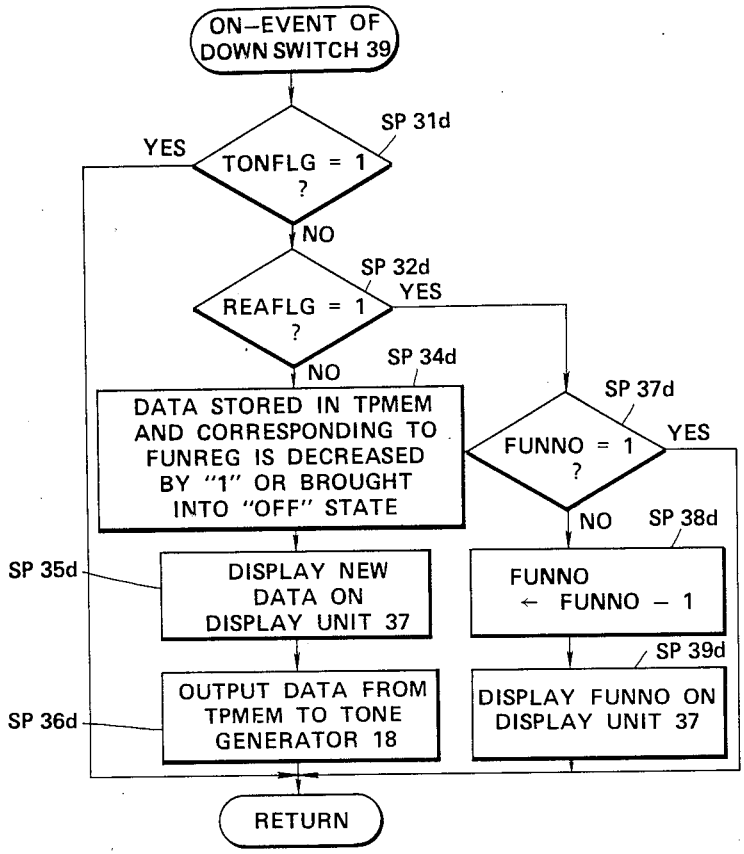

When the turning-on operation of the up switch 38 or the down switch 39, performed at the step OP5 of FIG. 13, is detected, a subroutine shown in FIG. 9 or 10 is executed.

In the case where the up switch 38 is turned on, the subroutine of FIG. 9 is executed from step SP31*u*, at which the CPU 11 determines whether the instrument 10 is in the tone-color selecting mode based on the flag TONFLG.

Since the up and down switches 38 and 39 need not be operated in the aforesaid tone-color selecting mode, as shown in FIG. 12, if the up switch 38 or the down switch 39 is operated in the tone-color selecting mode, this switch operation should be processed as a mistake. Therefore, if it is determined at the step SP31*u* that the tone flag TONFLG is in the state of "1", the processing returns to the main routine without performing any processing.

On the other hand, if it is determined at the step SP31*u* that the tone flag TONFLG is "0", the processing proceeds to step SP32*u*, at which it is further determined whether the reassignment flag REAFLG is in the "1" state. In the present case, the reassignment flag REAFLG is "0", so that the processing proceeds to step SP34*u*. At this step SP34*u*, the CPU 11 reads the identification number FUNREG from the register section MA6 to determine the factory-set function to be changed, and changes the parameter corresponding to this factory-set function and contained in the register section TPMEM. More specifically, if the factory-set function to be changed is a parameter represented by a value such as the "pitch bend range" designated by the identification number of "2" in FIG. 2, the parameter is increased by a predetermined value, for example, of "1". On the other hand, if the factory-set function to be changed is a function represented by a state, such as the "portamento ON/OFF" designated by the identification number of "4" in FIG. 2, the state of the function corresponding to this factory-set function and contained in the register section TPMEM is changed so that the function is brought into an active state. Then, the processing proceeds to the next step SP35*u*.

At the step SP35*u*, the CPU 11 displays the contents of the changed factory-set function on the display unit 37. The CPU 11 then outputs all the tone parameters contained in the register section TPMEM to the tone generator 18 at the next step SP36*u*. In this case, the CPU 11 may alternatively output only the data relating to the changed factory-set function to the tone generator 18. The CPU 11 then returns its control to the man routine.

In the case where the down switch 39 is turned on, the CPU 11 begins to execute the subroutine of FIG. 10, which is similar to the above-described subroutine of FIG. 9.

In this case, the processing proceeds through steps SP31*d* and SP32*d* to step SP34*d*. At this step SP34*d*, the CPU 11 reads the identification number FUNREG from the register section MA6 to determine the factory-set function to be changed. In the case where the factory-set function to be changed is a parameter represented by a value, the parameter is decreased by a predetermined value, for example, of "1". On the other hand, in the case where the factory-set function to be changed is a function represented by a state, the state of the function corresponding to this factory-set function and contained in the register section TPMEM is changed so that the function is brought into a disabled state. At the next step SP35*d*, the CPU 11 displays the contents of the changed factory-set function on the display unit 37. The CPU 11 then outputs all the tone parameters contained in the register section TPMEM to the tone generator 18 at the next step SP36*d*. In this case, the CPU 11 may alternatively output only the data relating to the changed factory-set function to the tone generator 18. The CPU 11 then returns its control to the main routine.

Thus, by operating the control elements in accordance with the procedure shown in FIG. 13, the parameter or function of any desired one of the factory-set functions can be changed to cause the sound system to output a musical tone in accordance with the changed parameter or function.

III Reassignment of user-set parameter to panel switch

III-1 Operating procedure

Figure 14:
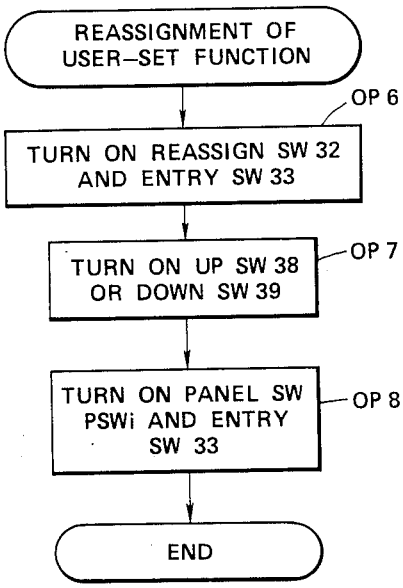
FIG. 14 is a flow chart of an operating procedure for reassigning a desired user-set function to the panel switch $PSW_i$.

When it is desired that a new function be assigned to the panel switch $PSW_i$ ("i" is any one of "1" to "10"), the player operates the control elements in accordance with the operating procedure shown in FIG. 14. More specifically, the player first turns on the reassignment switch 36 and the entry switch 33 substantially simultaneously, at step OP6, and confirms that all the LED indicators 34 to 36 go out. When the instrument 10 is brought into this function reassigning mode, all the LED indicators 34 to 36 should go out. The player then finds the identification number of that function, which he wishes to newly assign to the panel switch $PSW_i$, from the list printed on the panel at AR, and turns on the up switch 38 or the down switch 39 until the value displayed on the display unit 37 becomes equal to this identification number (step OP7). When the value displayed on the display unit 37 coincides with the identification number of the function to be assigned, the player turns on, substantially simultaneously, the entry switch 33 and the panel switch $PSW_i$ to which this function is to be assigned (step OP8).

If the panel switch $PSW_i$ is assigned the new function, the function precedingly assigned to the panel switch $PSW_i$ is canceled. Therefore, it is desirable that the new function be assigned to the panel switch $PSW_i$ only when the player actually so intend, and that the function precedingly assigned to the panel switch $PSW_i$ be not canceled by an erroneous switch operation by the player. In this embodiment, the switch operation at the step OP8 is so arranged that the player must simultaneously turn on two switches to avoid a loss of the precedingly assigned function due to an erroneous switch operation.

Shown in FIG. 14 is the basic operating procedure for the reassignment of a user-set function. Therefore, once the operation of the step OP6 has been performed other user-set functions can be assigned to the other panel switches by repeatedly performing the operation of the steps OP7 and OP8.

III-2 Operation of the instrument 10

Figure 11:
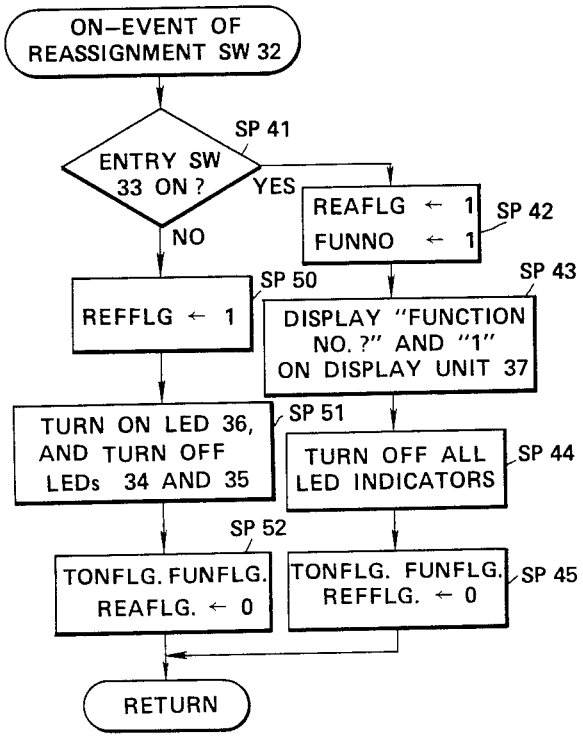

When the turning-on operation of the reassignment switch 32 performed at the step OP6 of FIG. 14 is detected, the CPU 11 begins to execute a subroutine shown in FIG. 11. At the first step SP41 of this subroutine, the CPU 11 determines whether the entry switch 33 is also turned on. In this user-set function reassigning mode, the entry switch 33 is turned on simultaneously with the reassignment switch 32 (refer to the step OP6 of FIG. 14). Therefore, the result of the determination at the step SP41 becomes "YES", so that the processing proceeds to step SP42.

At the step SP42, the CPU 11 renders the reassignment flag REAFLG, indicative of the state of this function reassigning mode, "1". The CPU 11 also sets the function identification number FUNNO, which will be used in this function reassigning mode, to the initial value of "1". At tee next step SP43, the CPU 11 displays a message indicative, for example, of "Function No. ?" together with the initial value of "1", to ask the player to operate the up switch 38 or the down switch 39. Then, the CPU 11 turns off, at step SP44, all the LED indicators 34 to 36 to inform the player that the instrument 10 is now in the user-set function reassigning mode. At the next step SP45, the CPU 11 clears the flags TONFLG, FUNFLG and REFFLG corresponding to the other modes. Then, the processing returns to the main routine.

After the above operation has been completed, the CPU 11 continues to execute the main routine of FIG. 5 along the loop LP to wait for a turning-on operation of the up switch 38 or the down switch 39. When a turning-on operation of the up switch 38 or the down switch 39 performed at the step OP7 of FIG. 14 is detected, the subroutine shown in FIG. 9 or 10 is executed.

In the case where the up switch 38 is turned on, the subroutine of FIG. 9 is executed from the step SP31*u*. In this reassigning mode, the reassignment flag REAFLG is in the "1" state (refer to the step SP42 of FIG. 11), so that the processing proceeds from the step SP31*u* through the step SP32*u* to step SP37*u*. At this step SP37*u*, the CPU 11 determines whether the function identification number FUNNO displayed on the display unit 37 is its maximum value of "30". If it is determined at the step SP37*u* that the displayed function identification number FUNNO is "30", then the CPU 11 returns its control to the main routine without performing any processing. On the other hand, if it is determined at the step SP37*u* that the displayed function identification number FUNNO is less than "30", then the CPU 11 increases the number FUNNO in the register section MA7 by "1", at step SP38*u*. At the next step SP39*u*, the CPU 11 displays the function identification number FUNNO thus increased on the display unit 37. Then, the CPU 11 returns its control to the main routine.

In the case where the down switch 39 is turned on, the CPU 11 executes the subroutine of FIG. 10.

In this case, the processing proceeds through steps SP31*d* and SP32*d* to step SP37*d*. At this step SP37*d*, the CPU 11 determines whether the displayed function identification number FUNNO is equal to its minimum value of "1". If it is determined at the step SP37*d* that the displayed function number FUNNO is greater than "1", the CPU 11 decreases the function identification number FUNNO in the register section MA7 by "1" at step SP38*d*. Then, the CPU 11 displays the decreased function number on the display unit 37 at the next step SP39*d*, and returns its control to the main routine.

Thus, the player changes the function identification number FUNNO, by operating the up switch 38 or the down switch 39, to thereby select a desired one of the thirty user-set functions. When the panel switch $PSW_i$ is turned on by the player after the selection of the desired function has been completed and during the time when the control of the CPU 11 is in the loop LP of FIG. 5, the CPU 11 begins to execute the subroutine of FIG. 7.

In this user-set function reassigning mode, only the reassignment flag REAFLG is in the "1" state (refer to the steps SP42 and SP45 of FIG. 11). Therefore, the processing proceeds from the step SP11 through the step SP12 to step SP47. At this step SP47, it is determined whether the entry switch 33 is also turned-on. If it is determined at the step SP47 that the entry switch 33 is not in the turned-on state, then the processing directly returns to the main routine. In this case, the assignment of the selected function to the panel switch $PSW_i$ is not performed. On the other hand, if it is determined at the step SP47 that the entry switch 33 is also turned-on, the processing proceeds to step SP48. At this step SP48, the CPU 11 reads the switch number SWNO from the register section MA5, and transfers the function identification number FUNNO contained in the register section MA7 to that address of the register section REFMEM which corresponds to the read switch number SWNO. The processing then returns to the main routine.

As described above, the function selected by the player is assigned to the panel switch $PSW_i$ which the player designates.

IV Change of contents of user-set parameter

IV-1 Operating procedure

Figure 15:
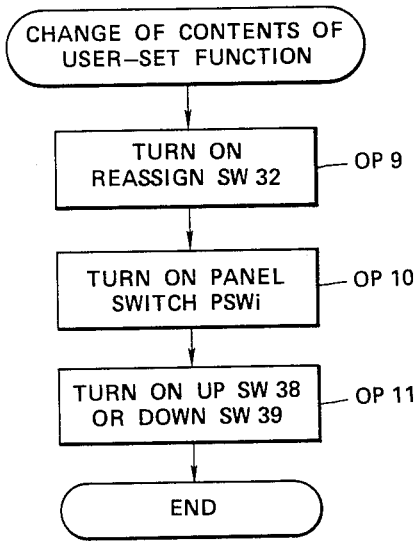
FIG. 15 is a flow chart of an operating procedure for changing the contents of a selected user-set function.

When it is desired that the contents of the parameter or function of the user-set functions be changed, the player operates the control elements in accordance with the operating procedure shown in FIG. 15. More specifically, the player first turns on the reassignment switch 32 at step OP9, and confirms that the LED indicator 36 corresponding to the reassignment switch 32 comes on. The player then turns on the panel switch $PSW_i$ ("i" is any one of "1" to "10"), to which the function which he wishes to change has been assigned (step OP10). At the next step OP11, the player turns on the up switch 38 or the down switch 39 until the contents of the parameter or function displayed on the display unit 37 become equal to the desired value or state.

Shown in FIG. 15 is the basic operating procedure for the change of user-set function Therefore, once the operation of the step OP9 has been performed, the contents of those user-set functions assigned to the other panel switches can be changed by repeatedly performing the operation of the steps OP10 and OP11.

IV-2 Operation of the instrument 10

When the turning-on operation of the reassignment switch 32 performed at the step OP9 of FIG. 15 is detected, the CPU 11 begins to execute the subroutine shown in FIG. 11 from the step SP41.

In this user-set function changing mode, the entry switch 33 is not turned on by the player. Therefore, the result of the determination performed at the step SP41 becomes "NO", so that the processing proceeds from the step SP41 to step SP50, at which the CPU 11 renders the reassignment function flag REFFLG "1". At the next step SP51, the CPU 11 turns on the LED indicator 36 corresponding to the reassignment switch 32, and turns off the other LED indicators 34 and 35. As a result, the player can confirm that the instrument 10 is now in the factory-set function changing mode. At the next step SP52, the CPU 11 clears the flags TONFLG, FUNFLG and REAFLG to cancel the precedingly selected mode. Then, the processing returns to the main routine.

When the turning-on operation of the panel switch $PSW_i$ performed at the step OP10 of FIG. 15 is detected during the time when the CPU 11 is carrying out the processing in the loop LP, the subroutine shown in FIG. 7 begins to be executed. In the present case, only the reassignment function flag REFFLG is in the "1" state (refer to the steps SP50 and SP52 of FIG. 11), so that the processing proceeds from the step SP11 through the step SP12 to step SP53. At this step SP53, the CPU 11 reads the switch number SWNO from the register section MA5, and then reads, from the register section REFMEM, the function identification number corresponding to the depressed panel switch $PSW_i$ which is indicated by the read switch number SWNO. Then, the CPU 11 stores the read function identification number into the register section MA6 as the identification number FUNREG of the user-set function whose contents are to be changed. Then, the processing proceeds to the step SP26.

The processing performed from the step SP26 (the step SP26 and the steps shown in FIGS. 9 and 10) in this user-set function changing mode is the same as that performed in the above-described factory-set function changing mode, and will not therefore be described here.

As described above, the player can change the contents of the user-set function assigned to the panel switch $PSW_i$ to cause the sound system to output a musical tone in accordance with the changed function.

With the arrangement of the above-described embodiment, the player can assign any desired parameter or function to each of the panel switches $PSW_1$ to $PSW_{10}$ so that he can set and control the parameters and functions by operating the panel switches in his own preferred manner. For example, the user-set functions can be assigned to the panel switches $PSW_1$ to $PSW_{10}$ such that the frequency of changes decreases from that assigned to the right-most panel switch to that assigned to the left-most panel switch. Also, the user-set functions can be assigned to the panel switches in the order of change in a music. In another way of assignment, the user-set functions are divided into groups, and the functions are assigned to the panel switches in groups.

In addition, with the above-described embodiment, since each of the panel switches $PSW_1$ to $PSW_{10}$ can be assigned by different functions in accordance with the modes of operation, the number of the panel switches can be decreased to render the size of the instrument 10 small.

In the above-described embodiment, a parameter or a function which can be assigned to each panel switch is one of those shown in FIG. 3. It will be, however, evident that the system can be modified so that any parameters and functions other than those shown in FIG. 3 (for example, tone colors) can be assigned to the panel switches.

The above-described operating procedure of the control elements in the user-set function reassigning mode is one example, and should not be restricted to the exact showing of FIG. 14.

With the structure of the above embodiment, the user-set functions assigned to the panel switches $PSW_1$ to $PSW_{10}$ are not displayed. It may be possible to modify the system so that the user-set functions assigned to the panel switches are displayed by display devices provided correspondingly to the panel switches. Alternatively, the functions assigned to the panel switches may be displayed at a portion of the display area of the display unit.

With the above embodiment, the control elements for selecting the factory-set functions and the control elements for selecting the user-set functions are constituted by the same panel switches $PSW_1$ to $PSW_{10}$. Alternatively, the control elements for selecting the factory-set functions and those for selecting the user-set functions may be provided separately.

With the above embodiment, the control of the reassignment of the user-set functions to the panel switches is performed by the programs executed by the CPU 11. Such control may alternatively be performed by a control circuit.

With the above embodiment, the number of user-set functions is thirty. It will be evident that the number of user-set functions may be more than or less than thirty, and may be even less than ten.

What is claimed is:

1. A parameter setting system for an electronic musical instrument for setting one or more of plural parameters each for determining a characteristic of a tone which is generated by a tone generating means incorporated in the electronic musical instrument, said parameter setting system comprising:

one or more manually operable members;

first memory means for storing the plural parameters in such an arrangement that each of the stored parameters can be designated by identification data;

data generating means having first manual control means for generating data whose value is determined by a manual operation of said first manual control means;

second memory means having one or more addresses corresponding respectively to said one or more operable members;

writing means responsive to a manual operation of each of said operable members for writing said data generated by said data generating means into a respective one of said addresses of said second memory means, as said identification data;

parameter setting means for bringing each of those of the plural parameters in said first memory means designated by the identification data contained in a corresponding one of said addresses of said second memory means into a desired condition;

tone generating means for generating a tone signal having characteristics determined by said parameters contained in said first memory means; and feeding means for feeding the parameters contained in said first memory means to the tone generating means so that the tone generated by the tone generating means has the characteristics determined by said fed parameters.

2. A parameter setting system according to claim 1, wherein said parameter setting means comprises:

reading means responsive to a manual operation of each of said operable members for reading the identification data from a corresponding one of said addresses of said second memory means; and changing means having second manual control means and responsive to each identification data read from said second memory means for changing, in accordance with a manual operation of said second manual control means, the parameter contained in said first memory means and designated by said read identification data.

3. A parameter setting system according to claim 2 further comprising mode selection means for selecting one of a first mode and a second mode, said writing means writing said data generated by said data generating means into said second memory means only when said first mode is selected, said reading means reading the identification data from said second memory means only when said second mode is selected 4. A parameter setting system according to claim 2, wherein each of the plural parameters stored in said first memory means is one of variable data or status data, said changing means changing the parameter to a desired value when the parameter is the variable data, said changing means changing the parameter to a desired state when the parameter is the status data.

5. A parameter setting system according to any one of claims 1 to 4 further comprising:

third memory means for storing a plurality of groups of parameters;

tone designating means for designating a tone color of the tone to output a tone-color designating signal; and parameter transferring means responsive to said tone-color designating signal for selectively reading one of said plurality of groups of parameters from said third memory means and for storing said read one group of parameters into said first memory means as said plural parameters.

6. A parameter setting system according to claim 3, wherein said mode selection means comprises a first switch means and a second switch means, said mode selection means selecting said first mode when both of said first switch means and said second switch means are operated substantially simultaneously, said mode selection means selecting said second mode when said first switch means is operated alone.

7. A parameter setting system for an electronic musical instrument comprising:

plural operating members each being manually operable;

assignment manner designating means for designating an assignment manner;

assigning means, connected to said assignment manner designating means, for assigning a particular parameter from among plural parameters, each of which determines a characteristic of a tone to be generated, to one of said plural operating members in accordance with said assignment manner, said parameter having a certain value and being able to take at least three values and said certain value being one of said at least three values;

parameter value changing means for changing said certain value to a new value, said changing means being enabled to change said certain value only when the operating member to which said particular parameter is assigned is operated; and tone generating means for generating a tone signal representing said tone to be generated, whose characteristics are determined by said plural parameters.

8. A parameter setting system according to claim 7 further comprising:

first memory means for storing values of said plural parameters; and reading means for reading said values from said first memory means and for providing said values to said tone generating means.

9. A parameter setting system according to claim 8 further comprising writing means for writing a new value into the area of said first memory means where said certain value is stored when said value changing means changes said certain value to said new value.

10. A parameter setting system according to claim 7 further comprising identification memory means having plural areas corresponding respectively to said plural operating members, the area of said identification memory means corresponding to said one of said plural operating members storing an identification number for identifying said parameter of said ceartain value.

11. A parameter setting system according to claim 7, wherein predetermined values of parameters are assigned respectively to said plural operating members in advance when said electronic musical instrument is turned on.

12. A parameter setting system for an electronic musical instrument comprising:

plural operating members each being manually operable;

assignment manner designating means for designating an assignment manner;

assigning means connected to said assignment manner designating means for assigning a parameter from among plural parameters to one of said plural operating members in accordance with said assignment manner, each parameter having a value associated therewith;

common manually operable parameter value control means for changing the value of a parameter when the operating member to which said parameter is assigned is operated; and tone generating means for generating a tone signal representing a tone to be generated, said parameters being imparted to said tone in accordance with the values thereof.

13. A parameter setting system according to claim 12 further comprising:

first memory means for storing a plurality of data representative respectively of the values of said plural parameters; and reading means for reading said plurality of data from said first memory means and for providing said read data to said tone generating means.

14. A parameter setting system according to claim 12, wherein predetermined parameters are assigned respectively to said plural operating members in advance when said electronic musical instrument is turned on.

* * * * *